United States Patent [19]

Megargee

[11] Patent Number: 4,548,190

[45] Date of Patent: Oct. 22, 1985

[54] AIR PROPELLED PROJECTILE LAUNCHER

[76] Inventor: Theresa M. Megargee, 14 Milo Dr., Madison, Conn. 06443

[21] Appl. No.: 501,793

[22] Filed: Jun. 7, 1983

[51] Int. Cl.[4] ..... F41B 11/00

[52] U.S. Cl. ..... 124/56

[58] Field of Search ..... 124/64, 56 R, 83, 1, 124/41 R, 80, 10; 446/197

[56] References Cited

U.S. PATENT DOCUMENTS

| | | | |
|---|---|---|---|
| 85,704 | 1/1869 | Snow et al. . | |
| 347,244 | 8/1886 | Horton . | |
| 1,521,510 | 12/1924 | Doughty . | |
| 2,228,206 | 1/1941 | Dwyer . | |
| 2,409,653 | 10/1946 | Amdur . | |
| 2,665,676 | 1/1954 | Mobley . | |
| 2,853,991 | 9/1958 | McLain . | |
| 3,055,352 | 9/1962 | Foster . | |
| 3,087,481 | 4/1963 | Foster | 446/197 X |
| 3,120,387 | 2/1964 | Weinstein . | |
| 3,513,819 | 5/1970 | Phillips | 124/64 |
| 3,580,234 | 5/1971 | Guyer et al. . | |
| 4,086,902 | 5/1978 | Reynolds . | |
| 4,159,705 | 7/1979 | Jacoby . | |
| 4,258,498 | 3/1981 | Aughey . | |

OTHER PUBLICATIONS

The cannon as shown in Popular Mechanics, p. 141, Aug. 1966.

*Primary Examiner*—Richard J. Apley
*Assistant Examiner*—William R. Browne
*Attorney, Agent, or Firm*—Costas, Montgomery & Dorman

[57] ABSTRACT

A toy projectile launcher having a barrel and having front and rear ends formed of a tubular resilient material defining a bore and having the rear of the barrel sealed with a plug member. A projectile having a diameter at least as large as the bore of the barrel is inserted in the front end of the bore and is launched by striking the barrel intermediate the ends thereof to compress air in the barrel, producing launching of the projectile.

11 Claims, 4 Drawing Figures

AIR PROPELLED PROJECTILE LAUNCHER

FIELD OF THE INVENTION

This invention relates to toy projectile launchers, and more particularly, relates to toy projectile launchers which may be in form of a gun, where a projectile is launched by compression of air.

BACKGROUND OF THE INVENTION

Toy projectile launchers in the form of handguns or cannons which launch a projectile under the influence of compression of air are well known. A device which utilizes a launcher which is generally in the form of a toothpaste tube and made of a pasteboard is disclosed in U.S. Pat. No. 2,228,206. This device is held in one hand and struck by the other hand to compress the air therein and to discharge a projectile which is fitted outside of the mouth of the device.

The prior patent art further shows toy air guns which are of a molded material and have a compressable handle to compress air within the molded device and expel a projectile which may be in the form of a ping pong ball. Such devices are shown in U.S. Pat. Nos. 2,853,991 and 3,055,352, among others.

U.S. Pat. No. 1,521,510 shows a toy cannon in which a housing attached to a barrel includes a hollow hemispherical bulb of a resilient material which is struck to compress air within the housing, which compression of air is transmitted to the barrel to expell a projectile.

Other devices have utilized a compressable balloon to compress the air for expelling a projectile, as shown in U.S. Pat. No. 3,580,234; and still other devices have used compressable members externally of a barrel to compress air within the barrel and expell a projectile, as exemplified in U.S. Pat. Nos. 2,409,653, 4,086,902, and 4,159,705.

This present invention provides a new, improved and inexpensive toy projectile launcher which may be in the form of a handgun or a toy cannon. The present invention is embodied in a very simple and inexpensive construction of safe materials, and is easy to operate.

SUMMARY OF THE INVENTION

The present invention provides a toy projectile launcher in which compression of air to expell or shoot the projectile is accomplished by deforming a resilient barrel member which is of hollow tubular configuration, having its rear end sealed so that upon deformation of the barrel to compress the air therein, the projectile is shot or launched from the front end.

The invention, in one form thereof, comprises a hollow barrel member of polyester foam material defining a bore, as hereinafter described. A plug member seals the rear end of the barrel. In the form of a handgun, the barrel is mounted to a more rigid handle member. To operate the toy gun, a projectile is inserted in the front end of the barrel and has substantially, an interference fit with the wall of the bore. The gun is held in one hand and the top of the barrel is struck either by the heel of the other hand or by a fist. This causes substantial collapse of the barrel, resulting in compression of air therein, which shoots or launches the projectile placed in the front end of the barrel.

An object of this invention is to provide a new and improved safe toy gun which will expel a projectile under the of pressure.

Another object of this invention is to provide a new and improved toy gun of the type described, which may be fabricated of stock materials without any special molding or forming of the parts thereof.

A further object of this invention is to provide a new and improved toy projectile of the type described, which requires only three parts in assembly, all of which are standard items which require no special forming.

The features of the invention which are believed to be novel are particularly pointed out and distinctly claimed in the concluding portion of this specification. The invention, however, both as to organization and operation together with further objects and advantages thereof, may best be appreciated by reference to the following detailed description taken in conjunction with the drawings.

DETAILED DESCRIPTION OF PREFERRED EMBODIMENTS OF THE INVENTION

Figure 1:
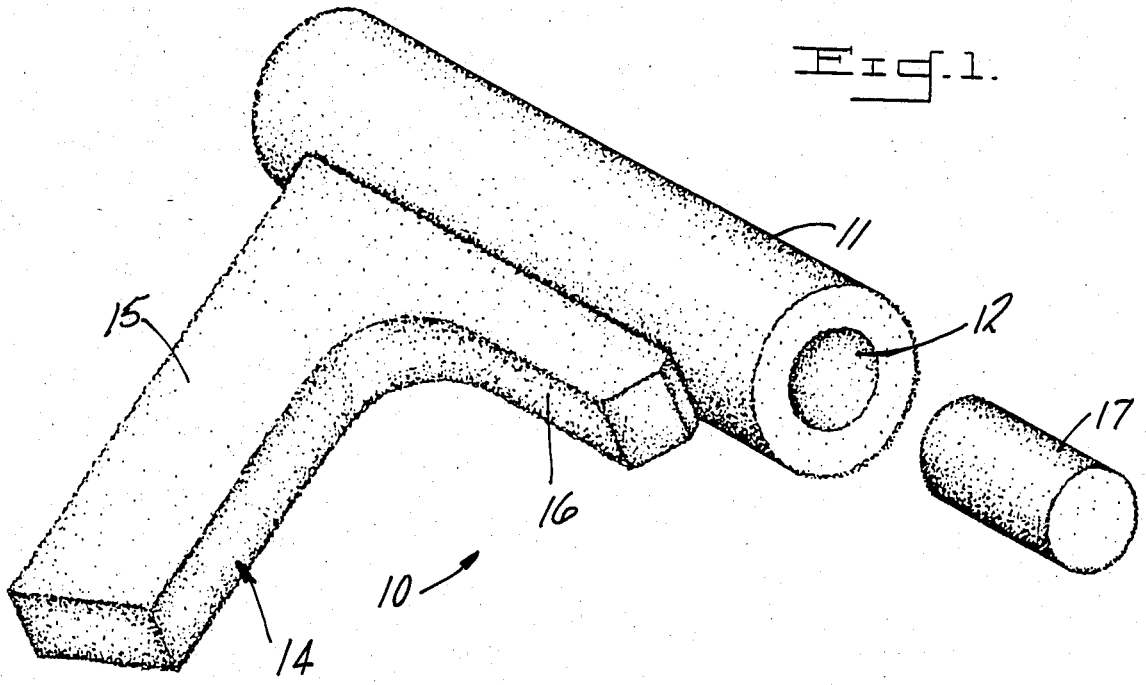
FIG. 1 is a perspective view of one form of a projectile launcher embodying the invention, showing the firing end.
Figure 2:
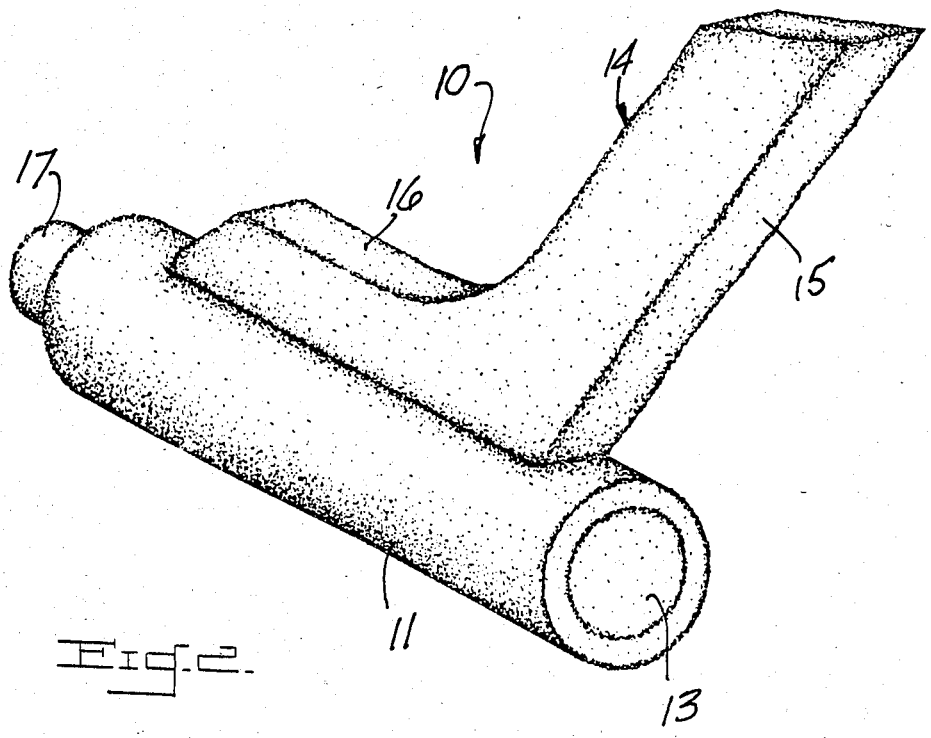
FIG. 2 is a perspective view of the toy gun of FIG. 1, showing the rear end thereof.

FIG. 1 exemplifies a projectile launcher in the form of a handgun 10 embodying the invention. The gun comprises a tubular barrel member 11, which is preferably a polyester foam of the type disclosed in U.S. Pat. No. 3,810,964. The barrel 11 is an extruded section, as described in the aforementioned patent, and comprises a tubular member having an interior wall defining a bore 12. To provide the desired resilience of the barrel, it is made of an extruded polyolefin foam in a density of approximately three to four pounds per cubic foot, and having a closed cell size of approximately two to four millimeters. A rear plug member 13, as shown in FIG. 2 is inserted into bore 12 and the outer periphery of plug member 13, is sealed to the inner periphery of the bore, either by heat fusion or by a suitable glue. In either case, the plug member forms with the walls of the bore an essentially airtight seal. Preferably, plug member 13 is of slightly greater diameter than the diameter of the bore 12, thus enhancing an airtight seal at the rear end of the bore. The plug is preferably two and one quarter to two and one half pounds per cubic inch and has a very fine cell size. A projectile, which is preferably of the same configuration and size as the plug 13 is hereinafter described.

A handle member 14 which may be of any desired design is preferably made of the same type of polyolefin foam previously described, but should be more rigid having a density of approximately five to six pounds per cubic foot, and a cell size of approximately seven to ten millimeters.

The handle 14 is mounted to the barrel 11, either by being glued thereto or heat fused thereto. The handle 14 has a hand grip portion 15 and a barrel support portion 16. The barrel support portion is preferably elongated along the length of the barrel so that it will provide reinforcement of the barrel along a substantial length thereof when the barrel is struck to expell a projectile as hereinafter described.

Figures 3, 4:
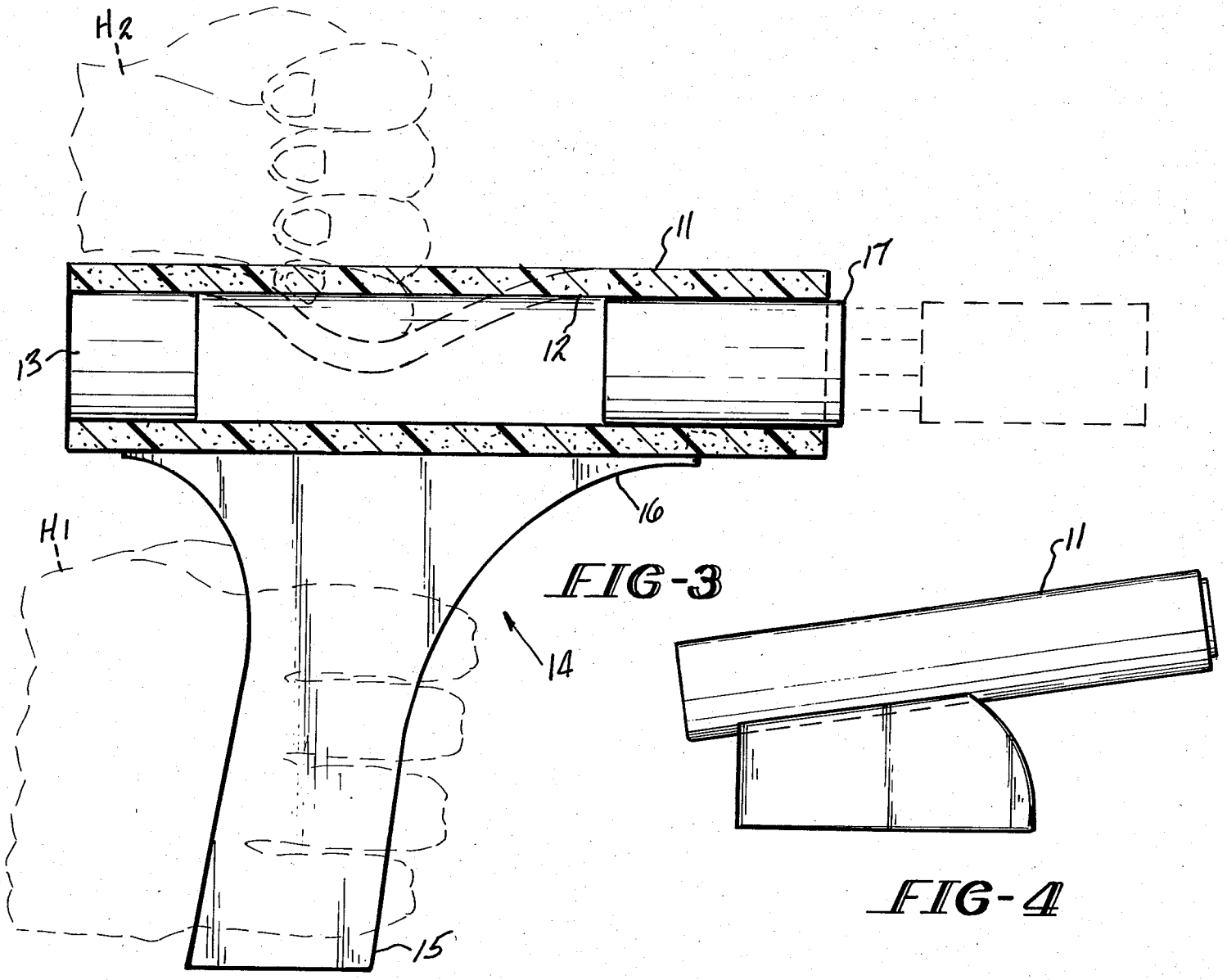
FIG. 3 is a side elevation of the toy gun embodying the invention, partly in section.
FIG. 4 is a side elevation of another toy projectile launching device embodying the invention.

Reference is now made to FIG. 3, which exemplifies a toy gun of FIGS. 1 and 2 in operation. The handle 14 of the device of FIG. 3 has a support portion 16 which is elongated in the direction of the barrel and extends substantially the length of the barrel. The support portion 16 curvingly tapers into hand grip portion 15. As shown, the handle is grasped by one hand indicated by H1, while the other hand H2 is utilized to strike the top of the barrel with the heel of the hand. Alternatively, if the user is small, a clenched fist may be utilized to strike the top of the barrel and cause compression of the barrel. The barrel is struck over the support portion of the handle and, preferably, closer to the rear end of the barrel over the handhold portion of the handle. Such striking of the barrel and resultant collapse thereof will compress the air in the barrel, between the point or area of striking and a projectile 17 inserted in the front end of the barrel. This compression will launch projectile 17. The material of the barrel is quite resilient and it will spring back to its original form, awaiting the insertion of another projectile for subsequent firing. The projectiles are also preferably of the same polyolefin foam as described for the plug 13. Such polyolefin foams are available from Packaging Industries Group, Inc. of Hyannis, Mass./or its subsidiary, Tuxis Corporation, Ltd. of Madison, Conn.

A toy gun embodying the invention, as shown in FIG. 3, has been constructed with the approximate dimensions:

| | |
|---|---|
| barrel length: | 6 inches |
| barrel outside diameter: | 1½ inches |
| barrel inside diameter: | 1 inch, plus zero, minus 1/16 inch |
| plug and projectile diameter: | 1 inch, minus zero, plus 1/16 inch |
| plug and projectile length | 1½ inch |
| handle: | 1⅛ inch thick with the dimension of the handle portion parallel to the longitudinal axis of the barrel, approximately 1¼ inch wide. |
| handle support portion, as secured to the barrel: | 4½ to 5 inches. |

The provision of the resilient barrel member adapted to receive a projectile of slightly larger diameter than the bore of the barrel and no less than the bore of the barrel provides a good air seal and insures that the air compressed in the barrel will primarily work on expelling the projectile with very little, if any, leakage between the outer periphery of the projectile and the inner periphery of the barrel. The barrel may be mounted against a substantially rigid support member for expelling the projectile. For example, the barrel could be fastened to the wrist of the user, or could be used as a toy floor cannon mounted on a base, as shown in FIG. 4.

In the embodiment shown in FIG. 4 a barrel 11 is affixed to a base member 18 which provides a support and reinforcement against a compression blow. Base member 18 may be placed on a floor or a table, and is formed to provide an elevation to the barrel.

While preferred embodiments of the invention have been described, alternate embodiments, as well as other embodiments of the invention may occur to those skilled in the art. Accordingly, the appended claims are intended to encompass all modifications and embodiments of the invention which do not depart from the spirit and scope of the invention.

Having thus described the invention, what is claimed is:

1. A projectile launcher for launching a cylindrical projectile, comprising a tubular resilient barrel member defining a cylindrical bore having an internal peripheral wall and having front and rear ends, said tubular barrel member being of an extruded cellular material which will compress when sharply struck, a member attached to said barrel member at the rear end thereof and forming an essentially airtight seal with said barrel member, a cylindrical projectile having an outside diameter at least as large as the diameter of said bore insertable into the front end of said barrel member to form an essentially airtight seal therewith, whereby when said barrel member is struck intermediate the ends thereof, the air in said barrel member is compressed and expels the projectile from the front end thereof, and a handle member affixed to said barrel member whereby said gun is adapted to be held in one hand and said barrel member struck with the other hand to launch said projectile.

2. The launcher of claim 1 where said barrel member is an extruded polyolefin closed cell foam.

3. The launcher of claim 1 where said member sealing said rear end is a plug member having a nominally larger outside diameter than the nominal diameter of said bore.

4. The launcher of claim 1 where said handle member is bonded to said barrel member and constructed and positioned to absorb impact from the striking of said barrel member.

5. The launcher of claim 4 wherein said handle member has an elongated portion in the direction of the barrel member which is bonded to said barrel member and curvingly tapering to a hand hold portion of said handle member.

6. A toy gun comprising a barrel member of hollow tubular form defining a bore having a peripheral wall, and having a rear end and a front end, said tubular barrel member being of an extruded cellular material which will compress when sharply struck, a member attached to said barrel member at the rear end thereof and forming an essentially airtight seal with said barrel member, and a handle member of substantially more rigid material than said barrel member affixed to said barrel member, a substantially cylindrical projectile member having a diameter at least as great as the bore of said barrel member adapted to be removably inserted into the front end of said barrel member and form a substantially airtight seal, with the peripheral wall defining said bore whereby when said barrel member is struck intermediate the ends thereof opposite said barrel member air is compressed in said barrel member to project said projectile from said front end.

7. The toy gun of claim 6 where said barrel member is made of a polyester foam.

8. The toy gun of claim 6 where said means sealing said rear end is a plug member having a diameter greater than the nominal diameter of said bore.

9. The toy gun of claim 6 where said projectile has a diameter greater than the nominal diameter of said bore.

10. The toy gun of claim 6 where said handle member is bonded to said barrel member and constructed and positioned to absorb impact from the striking of said barrel member.

11. The toy gun of claim 10 where said handle member has an elongated portion in the direction of the barrel curvingly tapering to a hand hold portion.

* * * * *

UNITED STATES PATENT AND TRADEMARK OFFICE

CERTIFICATE OF CORRECTION

PATENT NO. : 4,548,190

DATED : October 22, 1985

INVENTOR(S) : Theresa M. Megargee

It is certified that error appears in the above-identified patent and that said Letters Patent is hereby corrected as shown below:

Claim 6, column 4, lines 52 and 53 delete "opposite said barrel member"

Signed and Sealed this

Twentieth Day of November, 1990

*Attest:*

HARRY F. MANBECK, JR.

*Attesting Officer*

*Commissioner of Patents and Trademarks*